United States Patent [19]

Schefer

[11] Patent Number: 4,598,876

[45] Date of Patent: Jul. 8, 1986

[54] WINDING MACHINE FOR FILAMENT PACKAGES EQUIPPED WITH PACKAGE SCREENING MEANS

[75] Inventor: Kurt Schefer, Winterthur, Switzerland

[73] Assignee: Rieter Machine Works Limited, Winterthur, Switzerland

[21] Appl. No.: 707,425

[22] Filed: Mar. 1, 1985

[51] Int. Cl.[4] ..... B65H 54/02; B65H 67/044

[52] U.S. Cl. ..... 242/18 A; 242/18 DD; 242/18 PW

[58] Field of Search ..... 242/18 A, 18 PW, 18 DD, 242/18 R, 25 A, 56 A

[56] References Cited

U.S. PATENT DOCUMENTS

| | | | |
|---|---|---|---|
| 3,945,580 | 3/1976 | Veyrassat | 242/25 A |
| 4,119,278 | 10/1978 | Draizen et al. | 242/25 A |
| 4,497,450 | 2/1985 | Schefer et al. | 242/18 A |

FOREIGN PATENT DOCUMENTS

| | | | |
|---|---|---|---|
| 64148 | 5/1979 | Japan | 242/18 A |

*Primary Examiner*—Stanley N. Gilreath
*Attorney, Agent, or Firm*—Werner W. Kleeman

[57] ABSTRACT

In a thread winder comprising first and second chucks and a friction drive member selectively engageable by the chucks, there is provided a screening plate movable from a retracted position into an operative screening position between an idle position of the first chuck and the winding position of the second chuck which prevents thread tails dangling from a completed package on the first chuck from engaging and becoming entangled with the package forming upon the second, usually lower, chuck or the friction drive member. An auxiliary guide or deflector is provided for deflecting a thread during changeover of winding from the first, usually upper, chuck to the second, usually lower chuck. This auxiliary guide or deflector also cooperates with the screening plate to screen a package on the first chuck from a winding operation on the second chuck. A control system controls the retraction and advancement of the screening plate in response to operation of the winding machine.

11 Claims, 7 Drawing Figures

WINDING MACHINE FOR FILAMENT PACKAGES EQUIPPED WITH PACKAGE SCREENING MEANS

CROSS REFERENCE TO RELATED APPLICATIONS

This application is related to the commonly assigned, copending U.S. application Ser. No. 06/597,373, filed Apr. 6, 1984 and entitled "THREAD WINDING GEOMETRY". This application is also related to the commonly assigned, copending U.S. applications Ser. No. 06/412,014, filed Aug. 25, 1982, now abandoned, and its continuation application Ser. No. 06/657,177, filed Oct. 3, 1984 and each entitled "FILAMENT WINDING MACHINE", Ser. No. 06/411,701, now U.S. Pat. No. 4,497,450, granted Feb. 5, 1985 and entitled "FILAMENT WINDING MACHINE", and Ser. No. 06/411,908, filed Aug. 26, 1982, now U.S. Pat. No. 4,524,918, and entitled "FILAMENT WINDING MACHINE".

BACKGROUND OF THE INVENTION

The present invention broadly relates to a new and improved construction of a winding machine for filament packages which is particularly, but not exclusively, related to further developments of the winder disclosed in European published Patent Application No. 82107022.4, published under the publication No. 73,930 on Mar. 16, 1983, the full disclosure of which is hereby incorporated in the present application by reference. This European patent application corresponds to the aforementioned U.S. patent application Ser. Nos. 412,014, 411,701 and 411,908.

Generally speaking, the winding machine of the present invention serves for winding thread, especially synthetic plastic filament and comprises a friction drive member having a longitudinal axis and rotatable about this longitudinal axis. The winding machine also comprises a first chuck having a longitudinal axis and movable along a first predetermined path from a rest position thereof to a winding position thereof in which the first chuck is driven into rotation about the longitudinal axis thereof by the friction drive member, the first chuck being returnable to its rest position by movement along the first path. The winding machine also comprises a second chuck having a longitudinal axis and movable along a second predetermined path from a rest position thereof to a winding position thereof in which the second chuck is driven into rotation about the longitudinal axis thereof by the friction drive member, the second chuck being returnable to its rest position by movement along the second path. The first path is disposed above the second path.

Certain developments of the winder disclosed in the aforementioned European published Patent Application have been described in the likewise aforementioned U.S. application Ser. No. 597,373, filed Apr. 6, 1984, and the full disclosure of that U.S. application is also incorporated in the present application by reference.

Briefly, the winding machine disclosed in each of the aforementioned European published Patent Application, published under the publication No. 73,930 and U.S. application Ser. No. 597,373 comprises first and second chucks movable along respective paths from respective rest positions into operative relationship with a friction drive member. That chuck in operative relationship with the friction drive member is driven thereby into rotation about its longitudinal chuck axis so that a thread, usually a synthetic plastic filament, can be formed into a package by winding in a predetermined pattern around the chuck. Such a winding machine is referred to hereinafter as a "winder of the type described."

The chucks are moved successively into operative relationship with the friction drive member and a thread continuously delivered to the winding machine can be transferred from an "outgoing" to an "incoming" chuck. Thus, the continuously delivered thread is continuously taken up into packages forming on one or the other of the two chucks. While a package is forming on one chuck, a so-called "doffing operation" can be carried out on the other chuck while the latter is held in its rest or idle position. This doffing operation comprises the steps of removing the package formed on the relevant chuck during the immediately preceding winding operation, and replacing such package with an empty bobbin tube upon which the next package can be formed.

For convenience of description, reference will usually be made to only one package per chuck, however, as is now well known in the filament winding art, each chuck normally carries a plurality of (usually up to 8) bobbin tubes during any given winding operation and a corresponding number of thread packages are formed simultaneously. The principles described herein also apply to such multi-package winding systems.

In each of the embodiments of the prior art constructions, the chucks are disposed one above the other so that they approach their operative relationships with the friction drive member from opposite sides of a horizontal plane. In such an arrangement, a "working zone" of the winding machine can be at least approximately defined; the rest or idle position of the upper chuck lies above this working zone, the rest or idle position of the lower chuck lies below the working zone, and the friction drive member is located to one side of the working zone. Each chuck moves through the working zone in moving from its respective rest or idle position into operative relationship with the friction drive member, and also during the return movement towards the respective rest or idle position during build-up of a package between the chuck and the friction drive member.

Problems can arise since, while a chuck with a completed package is braked to a standstill, a thread tail on the package is thrown radially outwards by centrifugal force into the working zone. Also, when the upper chuck is stationary, a thread tail from a completed package carried by this chuck can hang down into the working zone. The thread tail may then become entangled in the newly forming package on the other chuck or in thread catching means on the chuck itself. This can represent a safety hazard for a person performing a doffing operation.

The problems presented by thread tails extending from completed packages are well known in the filament winding art, and various solutions have been put forward. In particular, U.S. Pat. Nos. 3,165,274, granted Jan. 12, 1965, and 3,409,238, granted Nov. 5, 1968, describe shields which can be interposed between a completed package and the friction drive member in order to prevent wrapping of a thread tail on the friction drive member. An alternative solution, involving a pivotable thread retainer, has been shown in the U.S. Pat. No. 4,327,872, granted May 4, 1982.

SUMMARY OF THE INVENTION

Therefore, with the foregoing in mind, it is a primary object of the present invention to provide a new and improved construction of a winding machine for filament packages which does not exhibit the aforementioned drawbacks and shortcomings of the prior art constructions.

Another and more specific object of the present invention aims at providing a new and improved construction of a winding machine of the previously mentioned type for filament packages which is particularly adapted to solve the abovementioned problems particularly in a winder of the type disclosed in the aforementioned European published Patent Application, published under publication No. 73,930 but which is also more widely applicable where machine design permits.

Yet a further significant object of the present invention aims at providing a new and improved construction of a thread winding machine of the type described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the winding machine of the present invention is manifested by the features that a screening or shielding means is movable from a retracted position into an operating position in which it is located between the rest or idle position of one chuck and the path of movement of the other chuck.

In other words, the present invention is manifested by the features that a screening means is movable from a retracted position thereof into an operative screening position thereof between the rest position of the first chuck and the winding position of the second chuck.

The screening means may have any form suitable for preventing passage of a thread tail beyond the screening means, but a preferred form is a rigid plate-like element. The element preferably extends over the full length of each chuck.

The retracted position of the screening means will depend upon the structure thereof and upon the overall design of the winding machine, particularly the available space therein. In a winder of the type described, a rigid, plate-like screening means is preferably disposed in its retracted position to the side of the working zone opposite the friction drive member. In the preferred embodiments of the winders shown in the prior art constructions, a thread deflector member is provided and is selectively operable to deflect a length of thread extending between the friction drive member and a completed package on the upper chuck when the latter is moved out of operative relationship with the friction drive member. This deflection of the length of thread renders it accessible to the incoming, lower chuck for catching thereby.

According to a preferred feature of the present invention, the screening means and an auxiliary member cooperate to screen-off a completed package from both a newly forming package and from the friction drive member. In a winder of the previously mentioned type, the thread deflecting element is preferably formed as the auxiliary member cooperating with the main screening means. It is not essential that the auxiliary and main screening means engage each other and form a completely continuous shield, but they preferably approach each other very closely. Both the main screening means and the deflecting member may have respective edges extending longitudinally of the friction drive member and disposed adjacent each other when the main screening means is in its operative position and the deflecting member is in the thread deflecting position.

The thread deflecting member is preferably movable, as in the prior art constructions, between a retracted position and an operative position. Previously, the deflecting member has been held in its operative position only long enough to enable a so-called "changeover" operation, that is, the transfer of the thread winding operation from the upper to the lower chuck. It is now proposed, however, to hold the thread deflecting member in its operative position throughout a winding operation on the lower chuck so as to function as an auxiliary screening means throughout that winding operation.

Further screening means may be provided to screen a completed package on the lower chuck from a newly forming package on the upper chuck and/or from the friction drive member. However, the problems associated with thread tails extending from packages on the lower chuck are not usually as severe as those associated with thread tails extending from the upper chuck. Suitable control means can be provided to coordinate movements of the screening means with movements of the chucks.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
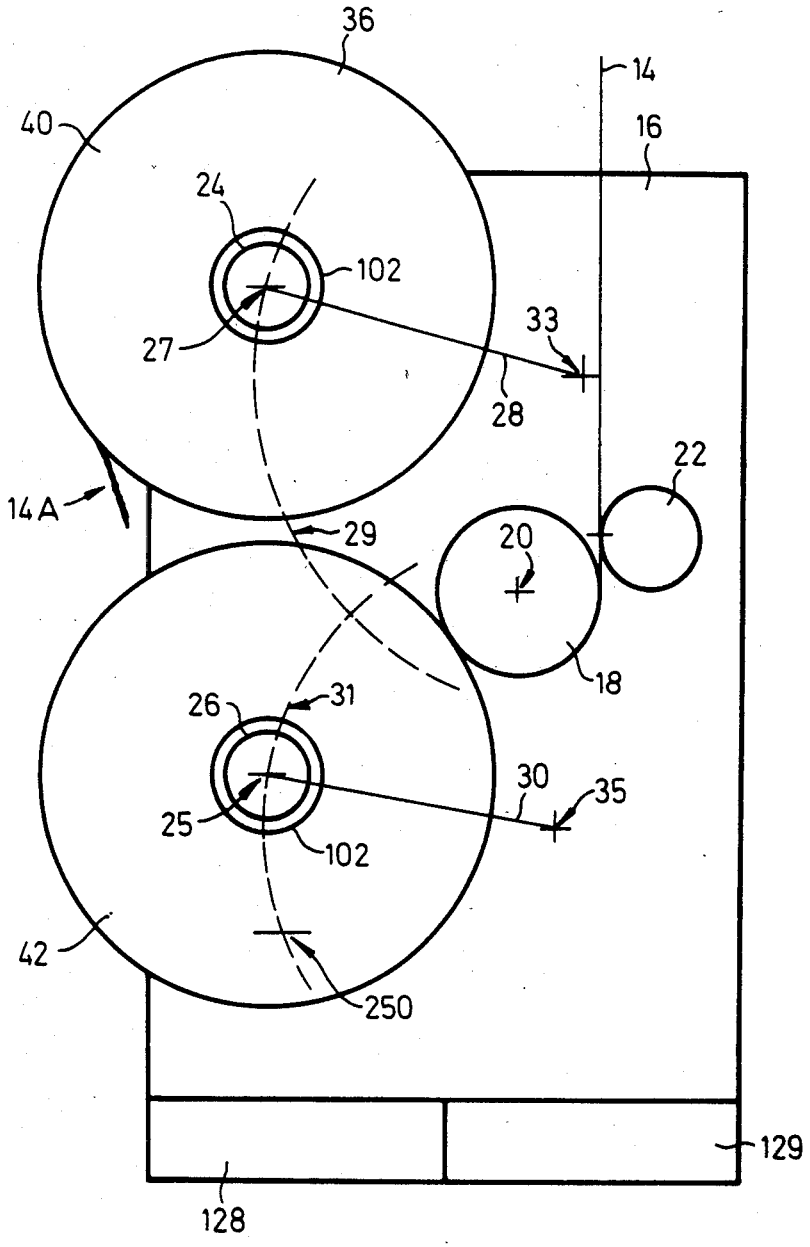
FIG. 1 shows a front elevation of a winding machine as illustrated in the aforementioned European published Patent Application, published under publication No. 73,930.
Figure 2:
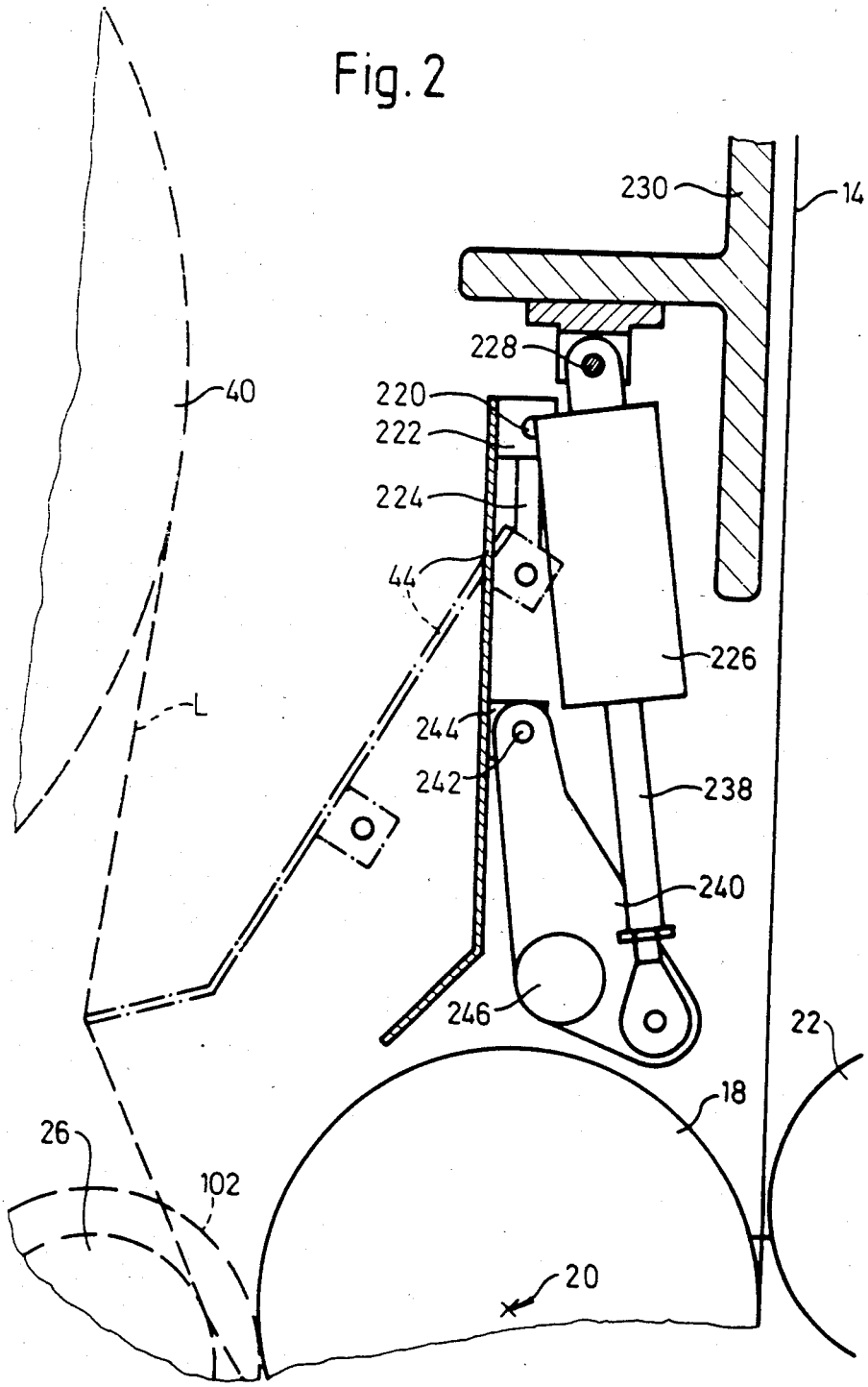
FIG. 2 shows a detail of the winding machine as shown in FIG. 1.

Describing now the drawings, it is to be understood that, to simplify the showing thereof, only enough of the structure of the winding machine or winder for filament packages has been illustrated therein as is needed to enable one skilled in the art to readily understand the underlying principles and concepts of this invention. FIG. 1 is a copy of FIG. 15 of European published Patent Application, published under publication No. 73,930, and FIG. 2 is a copy of FIG. 13 of the same application. In order to enable ready comparison, the original reference numerals have been retained for the present description. Since full details of the machine are available from the published European Patent Specification, only a very brief outline will be repeated in this specification. Turning attention now specifically to FIG. 1 of the drawings, the winding machine for filament packages illustrated therein by way of example and not limitation will be seen to comprise a headstock housing 16 containing not particularly illustrated drive systems, control systems and supports for the major operating elements or members which project forwardly from the front face of the headstock housing 16.

One such operating element or member is a friction drive roller 18 which is rotatable about its own longitudinal axis 20. Two other such elements or members are the chucks 24 and 26, each of which is rotatable about its respective longitudinal axis 27 and 25. The chucks 24 and 26 are supported to project cantilever-fashion from the front face of the headstock 16.

For the sake of simplicity, the present invention will assume the relatively simple winder geometry which was also assumed in the aforementioned European published Patent Application published under publication No. 73,930. In this geometry, the chuck axes 25 and 27 are supported parallel to the axis 20 of the friction drive roller 18. The chucks 24 and 26 are supported on respective swing arms 28 and 30 which are pivotable about respective pivot axes 33 and 35, each of which also extends parallel to the roller axis 20. A modification of this winder geometry particularly suitable for winding of heavy packages on long chucks has been previously described in the abovementioned U.S. application Ser. No. 597,373. Since the modification is not essential to the present invention, it will not be repeated herein. However, the present invention is equally applicable to the simple geometry shown in FIG. 1 or to the modified geometry as described in the aforementioned U.S. application Ser. No. 597,373.

Also for the sake of simplicity, the winder will be assumed to be processing only a single thread 14. The thread 14 is assumed to be delivered continuously to the winder, and is formed into thread packages 40 and 42 formed successively on the upper chuck 24 and the lower chuck 26, respectively. A package 40 is assumed to have been completed in a preceding winding operation, and the chuck 24 has been moved into its rest or idle position 36 in which the package 40 is spaced from both the friction drive roller 18 and the newly forming package 42 on the chuck 26. In this rest position 36, the chuck 24 will have been braked to a standstill and the bobbin tube 102, on which the package 40 has been formed, will have been released by the chuck 24 for removal therefrom during a doffing operation.

As illustrated in this exemplary embodiment, the newly forming package 42 is also approaching completion. At the illustrated stage of the winding operation, the chuck 26 is still in operative or driving relationship with the friction drive roller 18, namely through contact of such friction drive roller 18 with the cylindrical external surface of the newly forming package 42 forming on the chuck 26. During the winding operation, the axis 25 of the chuck 26 moves along the path 31 to enable build-up of the package between the bobbin tube 102 and the friction drive roller 18. At the completion of the winding operation on the chuck 26, that is, when the newly forming package 42 has reached the desired diameter, the chuck 26 is moved away from the friction drive roller 18, with the axis 25 still travelling along the path 31, to create a free thread length between the friction drive roller 18 and the newly forming package 42. This initiates a so-called "changeover" operation in which the thread 14 is transferred to the other chuck 24 in order to start winding of a new package 40 thereon.

In the meantime, the completed package 40 will have been removed from the chuck 24, along with the bobbin tube 102 upon which it was formed. A fresh bobbin tube 102 will have been mounted on the chuck 24 and secured thereto for rotation therewith, ready for the next winding operation involving this chuck 24. When the thread length referred to above has been formed between the outgoing, newly formed package 42 and the friction drive roller 18, a swing arm 28 can be operated to move the axis 27 of the chuck 24 downwardly along a path 29 in order to enable the chuck to intercept the free thread length such that a conventional thread-catching system, not particularly shown, mounted on the chuck 24 can catch the thread 14, separate it from the newly formed package 42 and cause it to wind into a new package 40 on the chuck 24. Winding around the chuck 24 is caused by rotation thereof through frictional contact with the friction drive roller 18, while the traversing of the thread 14 longitudinally of the chuck 24 and the friction drive roller 18 is effected by a conventional traversing mechanism 22.

Details of the creation of the free thread length during this changeover from the lower chuck 26 to the upper chuck 24 can be obtained from an examination of the prior art constructions. After the changeover operation has been effected, the chuck 26 is moved back into its rest or idle position in which the axis 25 lies at the intersection of the line 250 with the path 31. The newly formed package 42 is then clear of the friction drive roller 18 and the newly forming package 40. The chuck 26 is braked to a standstill and the newly formed package 42 can be removed by a suitable doffing operation, automated or otherwise. In completing the description of the illustrated exemplary embodiment, it is mentioned that part 129 represents a forwardly projecting foot resting in use on a suitable support surface, a portion 128 of which is cut away to receive the lowermost part of the package 42 when the chuck 26 is in its rest or idle position.

For the purposes of the present description, it is convenient to identify a region of the machine which will be called the "working zone." As viewed in FIG. 1, this zone is located forward of the headstock, to the left of the friction drive roller 18, above the line 250 and below the intersection of the path 29 with the swing arm 28.

It is not necessary to define the boundaries of the region defining this working zone precisely, but such region contains the paths of movement of the chucks 24 and 26 from their respective rest or idle positions into operative relationship with the winding or friction drive roller 18 and the envelopes of the spaces occupied by the packages 40 and 42 as they form on their respective chucks 24 and 26 and as they are moved back with the chucks 24 and 26 into the respective rest or idle positions thereof.

FIG. 2 shows the changeover from an outgoing completed package 40 to winding on the incoming empty chuck 26. In this case, an auxiliary deflector 44 is used to deflect the length of thread L between the outgoing package 40 and the friction drive roller 18 so that the deflected thread can be intercepted by the incoming chuck 26. The reasons for this are explained in the prior art included herein by reference and will not be repeated here. The auxiliary guide or deflector 44 is movable between a retracted position, shown in full lines in FIG. 2, and an operative position, shown in chain-dotted lines in this same Figure. The operating mechanism for causing this movement comprises, as illustrated, a conventional piston and cylinder unit, the cylinder 226 of which is pivoted at a location 228 to a frame member 230 of the machine. A connecting or piston rod 238 connects a not particularly shown piston of the piston and cylinder unit to a lever 240 which is pivoted at a location 246 and is pivotably connected at a location 242 to a lug 244 on the auxiliary guide or deflector 44. A second lug 222 carries a pin 220 sliding in a guide slot 224. Thus, as the auxiliary guide or deflector 44 is moved from its retracted to its extended position its leading edge is simultaneously moved further forward relative to its trailing end, so that the leading edge forms a deflector for the thread length L.

The operating mechanism which causes movement of the auxiliary guide or deflector 44 is not part of the present invention, but it is important to note that this auxiliary guide or deflector 44 has a retracted position in which it lies above the friction drive roller 18 and an extended position in which the leading portion or edge of the auxiliary guide or deflector 44 projects into the working zone of the machine as shown in chain-dotted lines in FIG. 2. As will also be seen in FIG. 2, the auxiliary guide or deflector 44 is a unitary element, but the forwardly projecting portion thereof can be in the form of a replaceable bar extending over substantially the full length of the package 40 or of all of the packages 40 where more than one such package is wound simultaneously in a given winding operation.

When a winding operation on the upper chuck 24 is completed, the thread 14 is transferred to the lower chuck 26 for winding thereon and the upper chuck 24 moves back to its rest or idle position and is braked to a standstill. During braking, a thread tail 14A (see FIG. 1) projecting from the completed package is thrown outwardly by centrifugal force.

It is a feature of the winding machine shown in FIG. 1 that a full package 40 can be "stored" on the upper chuck 24 in its rest or idle position throughout a complete winding operation to form a full package 42 on the other, lower chuck 26. This is not an essential feature, but it increases the flexibility of the machine with respect to doffing time. However, during storage of a full package 40 with the chuck 24 in its rest or idle position, the thread tail 14A may tend to hang from the full package 40 into the working zone of the machine. If this thread tail 14A becomes entangled with the chuck 26 or the newly forming package 42, or with the friction drive roller 18 during braking or storage, then it can cause serious problems and safety hazards. The present invention provides a solution by screening the full package 40 from the part of the working zone in which a newly forming package 42 is being formed.

Figure 3:
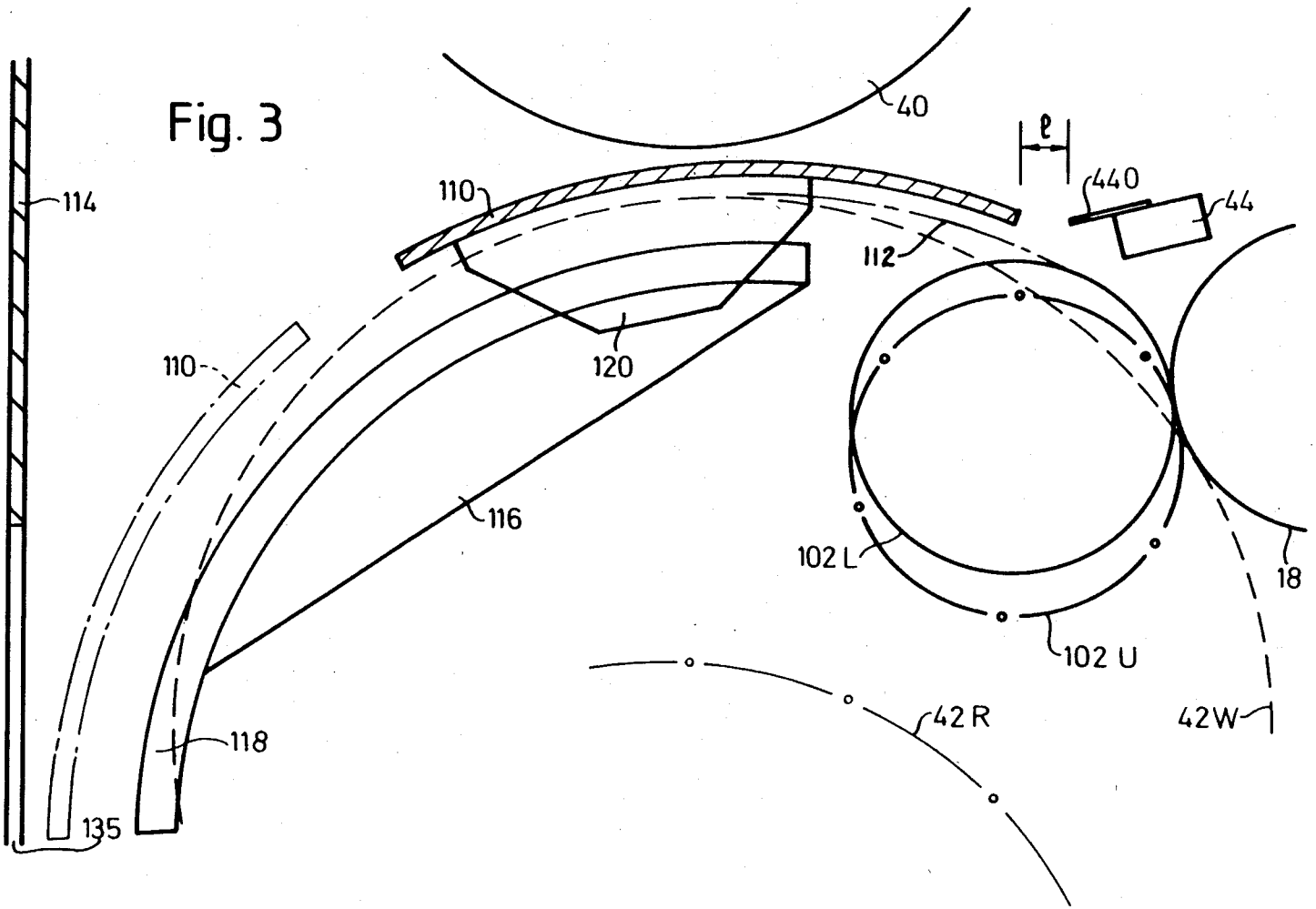
FIG. 3 shows a section through a modification to the winding machine as shown in FIG. 1 in order to bring it into accordance with the present invention.

For this purpose, the main screening means comprises a plate 110 shown in FIG. 3. The plate is semicircular or arcuate in cross-section and extends over the full length of the chucks 24 and 26. The plate 110 is movable from a retracted position shown in dotted lines in FIG. 3 into an extended position shown in full lines in this same Figure. The associated support and moving means will be described later with reference to FIGS. 4 and 5.

In FIG. 3, the lowermost portion of a completed package 40 can be seen at the upper edge of the Figure. The upper chuck 24 is assumed to be withdrawn into its rest or idle position and the illustrated completed package 40 is assumed to be of the maximum diameter for which the machine is designed.

Also, in FIG. 3 the bobbin tube 102L on the lower chuck 26 is shown in contact with the friction drive roller 18, indicating that winding has just commenced on the lower chuck 26. The dotted line 42W in FIG. 3 represents the outline of a fully wound package 42 on the lower chuck 26 and the chain-dotted line 112 represents the envelope of the build-up of the package 42 from the bare bobbin tube 102L to the completed package 42. It will be seen that the curvature of the screening plate 110 has been adapted to the envelope 112 such that a small spacing is left between the screening plate 110 and the envelope 112 at all points on the envelope 112.

The reference numeral 44A in FIG. 3 again represents part of an auxiliary guide or deflector structure similar to the auxiliary guide or deflector structure 44 in FIG. 2. In this case, however, only the leading edge portion of the auxiliary guide or deflector structure 44A has been shown. As before, this leading edge portion is retractable into a position above the friction drive roller 18 and is extendable into an operating position as shown in FIG. 3. The thread contacting portion of the auxiliary guide or deflector structure 44A comprises in the embodiment of FIG. 3, a replaceable bar 440 releasably secured to the main portion of the auxiliary guide or deflector structure 44. Both parts 44A and 440 of FIG. 3 and equally the auxiliary guide or deflector structure of FIG. 2 extend over the full length of the chucks 24 and 26. As illustrated in FIG. 3, the adjacent edges of the screening plate 110 and the replaceable bar 440 are spaced by a short distance 1. The distance 1 can be chosen empirically so that there is a negligible chance that a thread tail 14A hanging from a package 40 will penetrate the gap between the screening plate 110 and the replaceable bar 440 and make contact with the newly forming package 42. Both the screening plate 110 and the auxiliary guide or deflector structure 44 are retained in the illustrated, operative positions throughout build-up of the newly forming package 42 so that the package 40 is effectively screened off from both the newly forming package and the friction drive roller 18. This screening is effective to prevent penetration of a thread tail 14A from the package 40 into the lower portion of the working zone under three different conditions, namely:

(a) during braking of the completed package 40, at which time the thread tail 14A is thrown outwardly by centrifugal force and strikes against both the screening plate 110 and the auxiliary guide or deflector structure 44 as the completed package 40 decelerates to a standstill;

(b) when the completed package 40 is stationary but has not yet been removed from the chuck 24, as shown in FIG. 1, so that a thread tail 14A hangs from each completed package 40 on the chuck 24; and (c) during a doffing operation in which completed packages 40 are removed from the chuck 24 by shifting them axially of the chuck 24 and off the front end thereof. The screening plate 110 and the auxiliary guide or deflector structure 44 could therefore be returned to their retracted positions as soon as the doffing operation on chuck 24 is complete. As will be described, however, the preferred arrangement is one in which these parts 44 and 110 are maintained in a screening position until after winding of a package 42 on the chuck 26 has been completed.

The gap represented in FIG. 3 by the spacing 1 is preferably made as small as possible while avoiding engagement of the screening plate 110 with the replaceable bar 440, since very careful control would be required in order to avoid damage to these elements. The gap 1 can, however, be effectively eliminated by arranging an overlap of the screening plate 110 and the replaceable bar 440 without mutual contact thereof.

The screening plate 110 has been illustrated as moving on an arc around a lower portion of the working zone. This is not essential. The screening plate 110 could also be moved on an arc centered in the upper portion of the working zone and it could in principle move from a position above the friction drive roller 18 into its operative position. However, there is normally much more space available on the side of the working zone opposite the friction drive roller 18 and the illustrated arrangement leaves as much space as possible free around the package 40, which in turn assists doffing operations thereon.

Thread ends or tails 14A projecting from the lower package 42 do not represent the same magnitude of problems as thread ends or tails 14A projecting from the upper package 40. It is, however, possible to screen the lower package 42 also. Thus, the chain-dotted line 42R in FIG. 3 represents a portion of the outline of a full package 42 of maximum diameter when the chuck 26 has been moved back into its rest or idle position. The chain-dotted line 102U represents the outline of a bobbin tube 102 carried by the chuck 24 just after that bobbin tube 102 has made contact with the friction drive roller 18, indicating that a new package 40 has started to form on the upper chuck 24. Clearly, a screening plate analagous to the screening plate 110 could be moved from a position below the friction drive roller 18 into a position between the package 42R and a newly forming package 40 on the upper chuck 24. The same plate could screen the package 42R from the friction drive roller 18. However, it is believed that it will not be necessary to provide such an additional screening plate in most circumstances in a winder of the type described.

In the illustrated exemplary embodiment, the screening plate 110 is supported from an additional wall 114 which is secured to the headstock housing 16 so as to project forwardly therefrom on the left-hand side as seen in FIG. 1. The wall must be suitably shaped to avoid interference with the packages 40 and 42. At positions in front of and behind the working zone of the machine, that is at positions respectively spaced from and adjacent to the headstock housing 16, the wall 114 carries plates projecting towards the friction drive roller 18, one such plate, namely the rearward plate 116, can be seen in FIG. 3. The rearward plate 116 is generally triangular, being secured at its base to the wall 114. The other plate, not particularly illustrated, is similarly shaped. Each plate carries a curved rail, the rail carried by the rearward plate 116 being indicated by the reference numeral 118 in FIG. 3. These rails project a short distance from their respective plates towards, but not into, the working zone of the machine.

Figure 4:
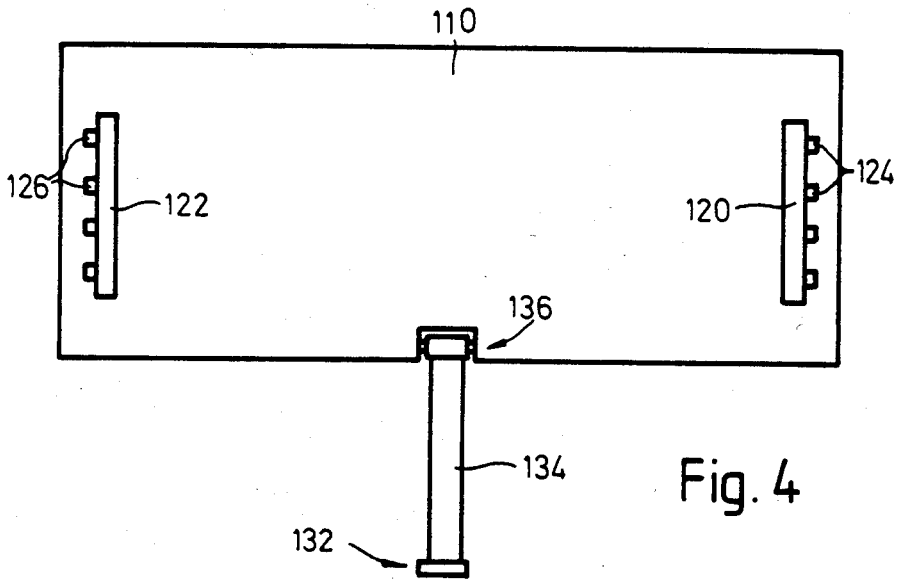
FIG. 4 shows a side elevation of a part also shown in FIG. 3.

The screening plate 110 is provided at its rear end, that is, near the headstock housing 16, with a slider 120 secured to the underside of the screening plate 110 and is provided near its front end with a similar slider 122, as shown in FIG. 4. This slider 120 carries suitable rearwardly projecting rollers 124 which engage the rail 118 and enable the slider 120 to move freely along that rail 118. A further slider 122 has similar, but forwardly projecting rollers 126 which engage the rail 118, not particularly illustrated in FIG. 4, on the front plate, also not particularly illustrated in FIG. 4, but referred to above. Thus, although the wall 114, the rail-supporting plates 116 and the rails 118 and the sliders 120 and 122 are not in themselves located in the working zone of the machine, they enable the central portion of the screening plate 110 to be moved freely into, and out of, the working zone.

Movement of the screening plate 110 is effected by a conventional piston and cylinder unit mounted on the side of the wall 114 facing away from the friction drive roller 18. This mechanism is visible in FIG. 5, in which the wall 114 is sectioned. The cylinder 128 of the piston and cylinder unit is fixedly secured to the wall 114 and the reciprocal piston, not particularly shown, of the piston and cylinder unit, moves a connecting or piston rod 130 up and down depending upon pressurization of the cylinder 128. The lower end of the connecting rod or piston 130 is connected by a pin joint 132 to a link 134 which is connected by a second pin joint 136 to the lower edge of the screening plate 110 at about the mid-length region thereof. The link 134 runs through a slot 135 in the wall 114.

Figure 5:
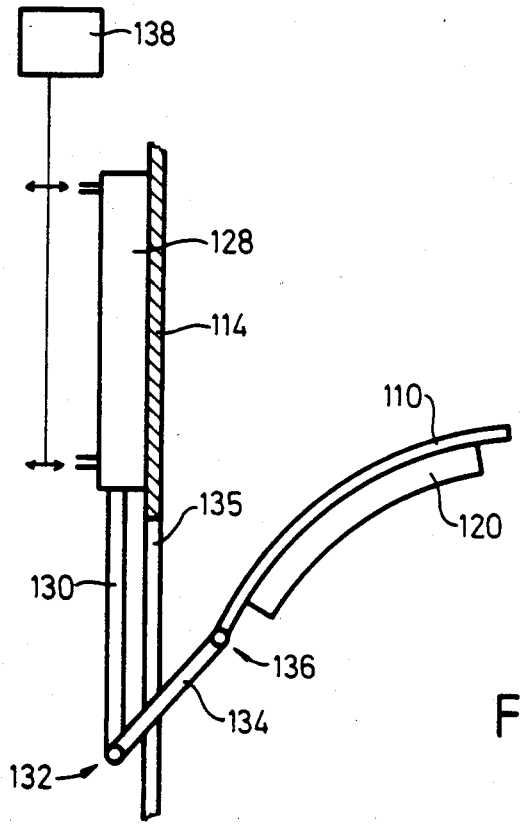
FIG. 5 shows a front elevation of an operating system according to the invention.

The control system, diagrammatically indicated at 138 in FIG. 5, controls pressurization of the cylinder 128 in response to signals derived from not particularly shown sensors responsive to the overall machine control system, one representative example of which was described in the aforementioned European published Patent Application, published under publication No. 73,930. For normal machine changeover from winding on the upper chuck 24 to winding on the lower chuck 26, the control system 138 may be adapted to respond to return of the chuck 24 into its rest or idle position so as to pressurize the cylinder 128 to draw the not particularly shown piston and the connecting or piston rod 130 upwardly. This drives the screening plate 110 from its retracted position into its operative position. The auxiliary guide or deflector structure 44 will already be in its operative position, since it is moved to that position during the changeover operation, as described in the aforementioned European published Patent Application, published under publication No. 73,930. If, however, it is desired to make a slight adjustment in the position of the auxiliary guide or deflector structure 44 between its "deflecting function" and its "screening function", then such adjustment could also be made in response to return of the chuck 24 to its rest position. Suitable adaptation would have to be made in the operating system for the auxiliary guide or deflector structure 44. However, it is preferred to avoid such complication where possible.

As already described, the screening plate 110 and the guide structure 44 remain in their screening positions throughout build-up or formation of a package 42 on the lower chuck 26. Each of these two elements 44 and 110 is returned to its retracted position in response to acceleration of the chuck 24 prior to movement thereof into a winding position in contact with the friction drive roller 18. Thus, when the overall machine control issues a signal causing acceleration of the chuck 24, the control system 138 is operated to pressurize the cylinder 128 so as to drive the piston and the connecting or piston rod 130 downwardly, returning the screening plate 110 into its retracted position. The operating system for the auxiliary guide or deflector structure 44 is operated simultaneously to withdraw the auxiliary guide or deflector structure 44 to its position above the friction drive roller 18. If desired, a manual override can be incorporated so that the control system 138 can be operated during build-up of a package 42 to "open" the screening system to enable inspection of the winding operation on the lower chuck 26.

Special arrangements may have to be made for a threading-up operation, in which thread is newly led into the machine, if the first winding operation of a series of such operations is effected on the lower chuck 26. In this case, the control system 138 can be operated at a suitable stage in the threading-up sequence control, for example, upon acceleration of the chuck 26 prior to movement thereof from the rest position into the winding position in contact with the friction drive roller 18. The auxiliary guide or deflector structure 44 will also be moved to its operative position as part of this threading-up operation.

The invention is not limited to details of the illustrated exemplary embodiment. In particular, it is not limited to the winder geometry shown in FIG. 1. For example, it is not necessary that the paths 29 and 39 cross as shown in FIG. 1. Also, if doffing can be assured at an early stage in the build-up of the next package, it is not necessary to arrange the winder geometry to enable storage of full packages throughout build-up of a succeeding package. The mounting and moving system for the screening plate 110 has been shown by way of example only and is by no means essential to the invention. The screening means itself is not necessarily in the form of a curved plate. If adequate space is available, the screening means could be linearly reciprocal. The screening plate is not necessarily rigid, it could be a flexible, rollable sheet as shown, for example, in U.S. Pat. No. 3,165,274.

Figure 6:
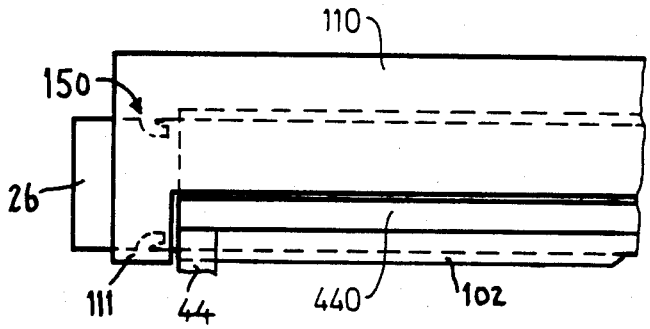
FIG. 6 shows a plan view of a first modified embodiment of the invention.

FIG. 6 shows a modification of the system described above with reference to FIG. 1. The modified system is viewed in plan from above and only the outboard end of a screening plate 110A is shown, as the modification to the screening plate 110 affects only this end portion. The reason for the modification can be appreciated by considering the dotted line illustration of the outboard end of the chuck 26 and the outboard bobbin tube 102 thereon.

As seen clearly in FIG. 6, the free end of the chuck 26 projects outwardly to the left well beyond the outboard bobbin tube 102. The portion of the chuck 26 outboard the bobbin tube 102 has a thread catching and cutting system generally indicated at 150 and formed, for example, in accordance with U.S. Pat. No. 4,477,034, granted Oct. 16, 1984, the disclosure of which is incorporated herein by reference. A thread deflector, serving as an auxiliary screening means, is indicated at 440A. This thread deflector 440A has been slightly modified in comparison with the auxiliary guide or deflector 44A shown in FIG. 3 in that the leading edge of the thread deflector 440A approaches the modified screening plate 110A very closely, so that the gap or spacing 1 shown in FIG. 3 has virtually disappeared. However, the thread deflector 440A does not extend leftwards as viewed in FIG. 6 beyond the outboard edge of the bobbin tube 102.

It is, however, possible, in the absence of the present modification, for the thread tail 14A (see FIG. 1) to be thrown outboard beyond the outboard end of the deflector 440A, and to be caught in catching and cutting means 150. To avoid this, the plate 110A is provided with an extension 111 which lies beside the outboard end of the thread deflector 440A and screens the package on the upper chuck 24 from the catching and cutting means 150 on the lower chuck.

The same effect could, of course, be achieved in principle by extending the deflector further outboard, but space problems associated with the mounting and moving systems for this deflector will often make such an alternative impractical.

Figure 7:
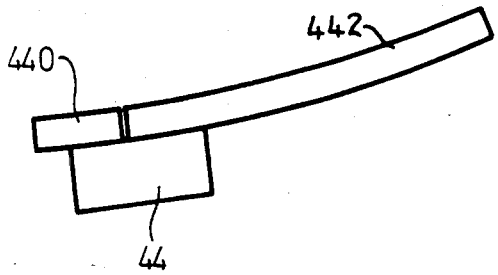
FIG. 7 shows a side view of a second modified embodiment of the invention.

FIG. 7 shows an additional modification to the combination of the deflector bar or replaceable bar 440 and its carrier, namely the auxiliary guide or deflector 44. If an outgoing completed package on the upper chuck 24 has a long projecting thread tail 14A, then this can be thrown by centrifugal force over the top of the deflecting structure formed by the combination of the auxiliary guide or deflector 44 and the replaceable bar 440, as shown in FIG. 3, and can be caught on the friction drive roller 18. In order to prevent this, a plate 442 is fitted on the carrier formed by the auxiliary guide or deflector 44 to extend away from the deflector bar or replaceable bar 440. The plate 442 is viewed in section in FIG. 7 and extends along the full length of the deflector bar or replaceable bar 440, thereby providing additional screening between the completed package or packages 40 on the upper chuck 24 and the friction drive roller 18.

The invention is not limited to winders of the type described. Broadly, the invention proposes the selective insertion of a screening means between a completed package and a newly forming package in a winder having a plurality of chucks and means enabling transfer of a thread to be wound from one chuck to another. Machines of this type are also shown, for example, in U.S. Pat. No. 4,298,171, granted Nov. 3, 1981, where a so-called revolver is used to carry the pair of chucks provided. The invention is also not limited to use with friction drives. It is known that the chucks can be driven directly by individual motors—the invention is equally applicable to winders using such drive systems.

While there are shown and described present preferred embodiments of the invention, it is to be distinctly understood that the invention is not limited thereto, but may be otherwise variously embodied and practiced within the scope of the following claims. Accordingly,

What I claim is:

1. A winding machine for thread, especially for synthetic plastic filament, comprising:

a friction drive member having a longitudinal axis and rotatable about said longitudinal axis thereof;

a first chuck having a longitudinal axis and movable along a first predetermined path from an idle position thereof to a winding position thereof in which said first chuck is driven into rotation about said longitudinal axis thereof by said friction drive member;

said first chuck being returnable to said idle position thereof by movement along said first predetermined path;

a second chuck having a longitudinal axis and movable along a second predetermined path from an idle position thereof to a winding position thereof in which said second chuck is driven into rotation about said longitudinal axis thereof by said friction drive member;

said second chuck being returnable to said idle position thereof by movement along said second path;

said first path being disposed above said second path; and screening means movable from a retracted position thereof into an operative screening position thereof between said idle position of said first chuck and said winding position of said second chuck for at least preventing a thread tail of said thread wound on said first chuck from acceding to a region near said winding position of said second chuck.

2. The winding machine as defined in claim 1, further including:

an auxiliary guide means for deflecting a thread during changeover of winding from said first chuck to said second chuck; and said auxiliary guide means cooperating with said screening means to screen a package on said first chuck from a winding operation on said second chuck.

3. The winding machine as defined in claim 2, wherein:

said auxiliary guide means has a screening position;

said screening means and said auxiliary guide means each having an edge extending substantially parallel to said friction drive member; and said edges being mutually adjacent when said screening means is in said operative screening position thereof and said auxiliary guide means is in said screening position thereof.

4. The winding machine as defined claim 1, further including:

a control system responsive to operation of the winding machine for retracting said screening means into said retracted position enabling preparation of a winding operation which is to be accomplished on said first chuck.

5. The winding machine as defined claim 1, wherein:

said screening means comprises a curved plate movable along an arc from said retracted position thereof to said operative screening position thereof.

6. The winding machine as claimed in claim 1, wherein:

said retracted position of said screening means is on a side of a working zone of the winding machine opposite said friction drive member and adjacent said idle position of said second chuck.

7. The winding machine as defined in claim 1, further including:

means for transferring a thread from a completed package wound on said first chuck to said second chuck for starting winding of a package thereon; and said screening means being movable from said retracted position into said operative screening position between said completed package on said first chuck and a newly forming package on said second chuck.

8. The winding machine as defined in claim 7, wherein:

said friction drive member is capable of selectively driving said first chuck and said second chuck into rotation about said respective longitudinal axis thereof; and said screening means being capable, when in its operative screening position, of screening said completed package from said friction drive member.

9. The winding machine as defined in claim 1, wherein:

said screening means extends over a major portion of the length of said first and second chucks.

10. The winding machine as defined in claim 1, wherein:

said screening means extends over substantially the full length of said first and second chucks.

11. A winding machine for thread, especially for synthetic plastic filament, comprising:

a rotatable member having a longitudinal axis and rotatable about said longitudinal axis thereof;

a first chuck having a longitudinal axis and movable along a first predetermined path from an idle position thereof to a winding position thereof in which said first chuck is driven into rotation about said longitudinal axis thereof while receiving at least one thread from said rotatable member;

said first chuck being returnable to said idle position thereof by movement along said first predetermined path;

a second chuck having a longitudinal axis and movable along a second predetermined path from an idle position thereof to a winding position thereof in which said second chuck is driven into rotation about said longitudinal axis thereof while receiving at least one thread from said rotatable member;

said second chuck being returnable to said idle position thereof by movement along said second path;

said first path being disposed above said second path; and screening means movable from a retracted position thereof into an operative screening position thereof between said idle position of said first chuck and said winding position of said second chuck for at least preventing a thread tail of said thread wound on said first chuck from acceding to a region near said winding position of said second chuck.

* * * * *